US007487833B2

(12) United States Patent
Grigar et al.

(10) Patent No.: US 7,487,833 B2
(45) Date of Patent: Feb. 10, 2009

(54) SAFETY APPARATUS FOR PERFORATING SYSTEM

(75) Inventors: Larry Grigar, East Bernard, TX (US); Joe C. Hromas, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 140 days.

(21) Appl. No.: 11/308,876

(22) Filed: May 18, 2006

(65) Prior Publication Data

US 2007/0267195 A1 Nov. 22, 2007

(51) Int. Cl.
*E21B 29/00* (2006.01)

(52) U.S. Cl. ..... 166/297; 166/55.2; 175/4.54

(58) Field of Classification Search ..... 166/55.2, 166/297; 175/4.54, 4.56; 89/1.15
See application file for complete search history.

(56) References Cited

U.S. PATENT DOCUMENTS

| | | | | | |
|---|---|---|---|---|---|
| 2,142,583 | A | * | 1/1939 | Yarbrough | 175/4.55 |
| 3,183,972 | A | * | 5/1965 | Fredd | 175/4.52 |
| 3,199,287 | A | * | 8/1965 | Kinley | 60/636 |
| 4,292,895 | A | | 10/1981 | Bell | |
| 4,306,628 | A | * | 12/1981 | Adams et al. | 175/4.56 |
| 4,523,650 | A | * | 6/1985 | Sehnert et al. | 175/4.56 |
| 4,561,356 | A | * | 12/1985 | Bordon | 102/202.1 |
| 4,967,048 | A | | 10/1990 | Langston | |
| 5,027,708 | A | * | 7/1991 | Gonzalez et al. | 102/254 |
| 5,070,788 | A | | 12/1991 | Carisella | |
| 5,159,145 | A | | 10/1992 | Carisella | |
| 5,161,616 | A | | 11/1992 | Colla | |
| 5,165,489 | A | * | 11/1992 | Langston | 175/4.54 |
| 5,223,665 | A | | 6/1993 | Burleson et al. | |
| 5,237,136 | A | * | 8/1993 | Langston | 200/81 R |
| 5,277,262 | A | * | 1/1994 | Huber et al. | 175/4.54 |
| 5,346,014 | A | | 9/1994 | Ross | |
| 5,392,860 | A | | 2/1995 | Ross | |
| 5,436,791 | A | | 7/1995 | Turano | |
| 5,483,895 | A | | 1/1996 | Tomek | |
| 6,095,258 | A | | 8/2000 | Reese | |
| 6,779,605 | B2 | * | 8/2004 | Jackson | 166/297 |

FOREIGN PATENT DOCUMENTS

| | | | |
|---|---|---|---|
| GB | 2054107 | A | 2/1981 |
| WO | WO 94/10422 | A1 | 5/1994 |
| WO | 199421882 | A1 | 9/1994 |

* cited by examiner

*Primary Examiner*—David J Bagnell
*Assistant Examiner*—Cathleen R Hutchins
(74) *Attorney, Agent, or Firm*—Clarence E. Eriksen & Associates, P.C.; Kevin B. McGoff; Bryan P. Galloway

(57) ABSTRACT

Safety apparatus is disclosed for providing ballistic train interruption in a perforating system. The safety apparatus comprises a generally tubular shaped housing having first and second ends which are fabricated to permit the housing to be positioned at any location in the perforating system. The apparatus comprises first and second ballistic sections in the housing and a third ballistic section which is rotatably mounted in the housing to move between a disarmed position and an armed position based on downhole pressure. Upon retrieval of the perforating system from the wellbore, the safety apparatus functions to return a third ballistic section to its disarmed position. Additionally, apparatus is provided to permanently disable the third ballistic section to insure that no inadvertent detonation of the guns occurs when retrieving the system from a wellbore.

20 Claims, 5 Drawing Sheets

SAFETY APPARATUS FOR PERFORATING SYSTEM

BACKGROUND OF THE INVENTION

1. Field of the Invention

The present invention relates to a safety apparatus for a perforating system.

2. Description of the Prior Art

Safety is a substantial issue in connection with the providing of perforating services and procedures and is of the utmost concern on a tubing conveyed perforating ("TCP") job when the firing head is first attached to the gun string or when a firing head is removed from a non-detonated gun string which has been retrieved from its downhole position. The attachment or removal of the firing head has typically been done on the rig floor when personnel are near the equipment, and if detonation occurs at this time, severe property damage and bodily harm, including death, may result.

One safety technique which has been employed is to install a predetermined length of pipe with no shape charges, e.g., 10 feet, on top of a gun string prior to installing the firing head. By following this procedure, the gun string is below the rig floor when the firing head is being installed. If the guns were to detonate when the firing head is installed, the harm to human life would be somewhat protected inasmuch as personnel are not directly in the line of fire of the guns. Another safety technique has been to require that two parameters, e.g., mechanical action and pressure, be satisfied in order to detonate the firing head. At the surface where the firing head is installed, there is typically insufficient pressure to satisfy the pressure requirements, and the firing heads can be considered safe while at the surface.

Other safety systems employ techniques where the firing head is mechanically blocked until the system is downhole near the zone to be perforated. These systems are known as "downhole arming" systems and can include eutectic material which is solid at low temperatures and melts at slightly higher temperatures. These eutectic materials function to block a firing pin from impacting a detonator at the surface. When the system is run downhole, however, the eutectic material melts and the firing pin has a clear path to strike the detonator. A drawback to this type of system is that, once the eutectic material melts, it flows away from its original blocking cavity. Thus, when a non-detonated gun string is retrieved from the well, the path of the firing pin to the detonator would no longer be blocked.

Other safety methods may include a utilization of techniques to interrupt the ballistic train from the firing head to the gun string. One such device called a "hammer stop" also utilizes eutectic material as described above. The eutectic material is physically positioned to block the path of the firing pin from impacting a percussion detonator. As the system is run into the well, the downhole temperature increases and the eutectic material melts. The physical barrier between the firing pin and the detonator is thus removed.

Another ballistic interruption-type safety method involves the use of a radial blocking pin. The pin is positioned between a firing pin and a percussion detonator, and the pin is held in the blocked position by a spring. The pin has O-ring seals and seals against an atmospheric chamber. As the system is run into the hole, well pressure causes the pin to move against the atmospheric chamber. When the pin is moved to its final position, a hole in the pin allows the firing pin to have a clear path to the detonator.

SUMMARY OF THE INVENTION

Safety apparatus in accordance with the present invention functions to provide a ballistic train interruption in a perforating system, which prevents the ballistic train from transferring from one ballistic section to another ballistic section. Apparatus in accordance with the present invention comprises a generally tubular-shaped housing with first and second ends and with end connectors on each end to permit the apparatus to be positioned at any location in the perforating string. Normally, however, the generally tubular-shaped housing is run, i.e., positioned, between the firing head and the gun string which is beneficial especially if a firing head is run on the bottom of the gun string.

The housing contains first and second ballistic sections which extend from the first and second ends toward the middle of the apparatus. The housing also comprises a third ballistic section which is rotatably mounted in the middle portion of housing to move from a disarmed to an armed position. In the disarmed position, the third ballistic section is misaligned with the first and second ballistic sections. The third ballistic section is aligned with the first and second ballistic sections in the armed positions. The rotatable mounting of the third ballistic section may advantageously be effected in one embodiment by using trunions. In its disarmed state, the third ballistic section may be held in a misaligned position by a spring, and in one embodiment, that spring comprises a leaf spring.

Safety apparatus in accordance with the present invention further comprises an annular piston which surrounds the third ballistic section and which is movable from a first to a second position. The annular piston is held in the first position by a compression spring, when there is no pressure on the safety apparatus. In this situation, the third ballistic section held in a position that is misaligned with the first and second ballistic sections. Thus, if the firing head were inadvertently to fire, the detonation of the detonating cord would be interrupted. If safety apparatus according to the present invention were to be placed between the firing head and the guns, the guns could not detonate.

The annular piston is biased to compress the compression spring when under pressure. As apparatus in accordance with the present invention is run into the hole, downhole pressure forces the annular sealed piston against the compression spring. A surface on the inside of the annular piston contacts the misaligned, third ballistic section. As the annular piston continues to move, the third ballistic section is rotated into alignment with the first and second ballistic sections. Pressure on the annular piston holds the third ballistic section in this position and the ballistic train can now transfer through the interrupt section and detonate the guns.

When a gun string and a firing head which have been downhole but which have not been detonated are retrieved to the surface, the device works in reverse. As pressure is reduced on the tool, the spring compression forces the annular piston to its original position. As this happens, the inner surface of the annular piston which was in contact with the third ballistics section retracts and the leaf spring mounted on one side of the third ballistics section rotates it out of alignment with the first and second ballistics sections. This results in the detonating cord being interrupted and detonation cannot transfer.

Safety apparatus in accordance with the present invention may further comprise structure to permanently disarm the third ballistics section in the tubular-shaped housing. Such apparatus may, for example, include a frangible member such as a rupture disc which may be advantageously positioned in the biased annular piston and exposed to wellbore pressure. The rupture disc may be appropriately sealed, e.g., with O-rings, so that a second sealed chamber exists at atmospheric pressure until the rupture disc is burst. A fluid port is positioned beneath the rupture disc and interconnected with a second chamber in the housing.

If it is desired to permanently disable the short ballistics section, the wellbore in which the safety apparatus of the present invention is utilized may be over-pressured to burst the rupture disc. Once the rupture disc is burst, well fluid will enter the second chamber, and wellbore pressure in combination with the compression spring force back the annular piston in its initial position. After the rupture disc has burst, further fluctuations of well pressure have no effect on the annular piston position and the ballistics in the third ballistics section will permanently remain in a misaligned position.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not to limit the present invention.

While the following description may focus on the use of the safety apparatus of the present invention in a tubing conveyed perforating system, those skilled in the art will appreciate that the safety apparatus may also be utilized in wireline and coiled tubing perforating systems with little, if any, modification. The applicants intend, therefore, that the appended claims, unless expressly limited to a tubing conveyed perforating system, should be interpreted so as to cover the invention when used in tubing conveyed, wireline or coiled tubing perforating systems.

Figure 1:
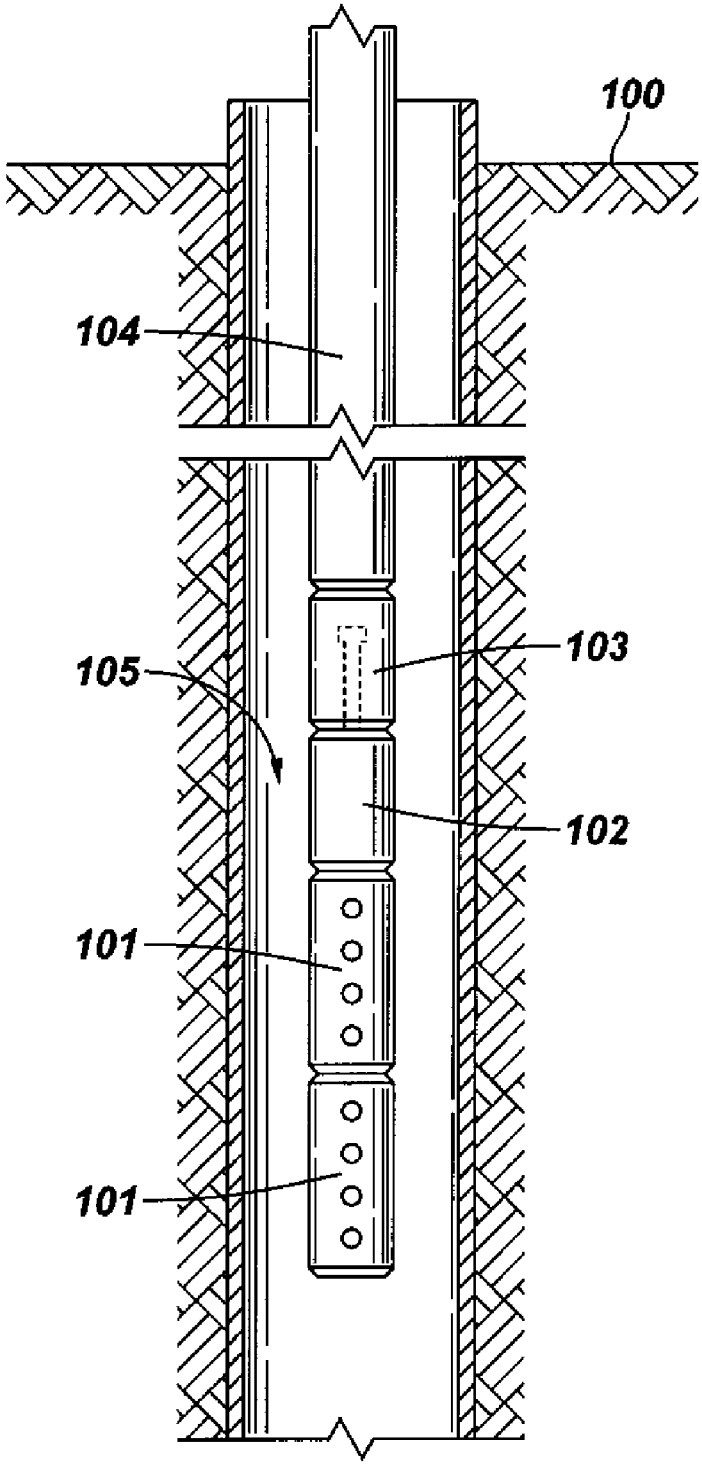
FIG. 1 is a pictorial diagram illustrating a tubing conveyed perforating system in accordance with the present invention.

Referring first to FIG. 1, there is illustrated a tubing conveyed perforating system in accordance with the present invention. The tubing conveyed perforating system may, for example, be assembled at the rig floor 100, and the system comprises at least one perforating gun section 101, with two such gun sections 101 being illustrated in FIG. 1. The tubing conveyed perforating system further comprises firing head 103 and additional joints of tubular members 104. The number of tubular members 104 that are used in the tubing conveyed perforating system will be determined by the depth to which the perforating gun sections 101 are to be lowered in wellbore 105.

Figure 2:
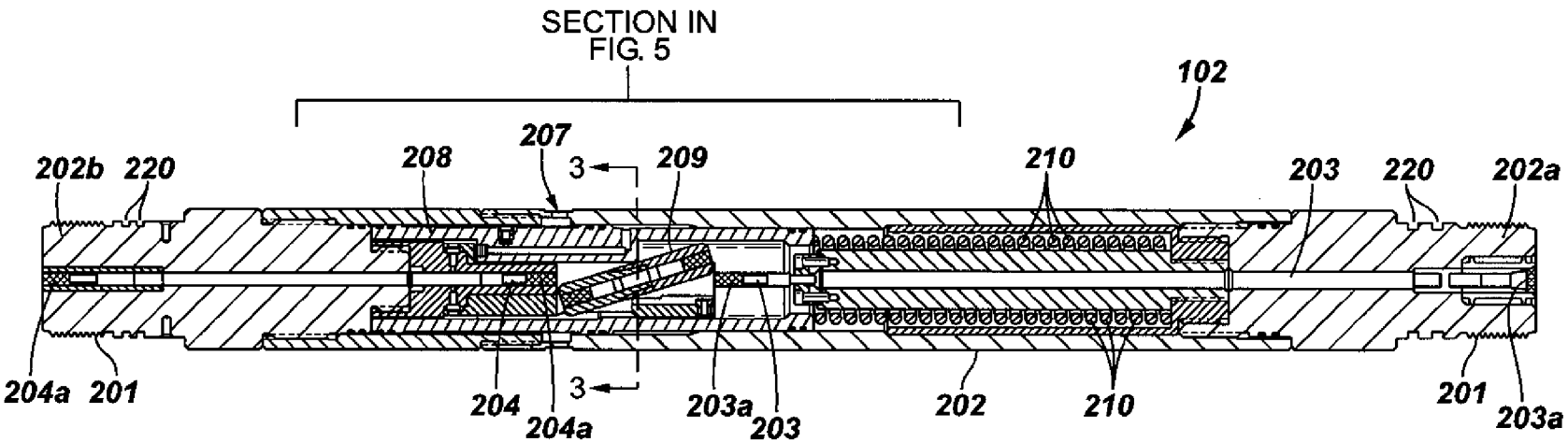
FIG. 2 is a cross-sectional view taken along the longitudinal axis of safety apparatus in accordance with the present invention which illustrates the apparatus in the disarmed position.
Figure 4:
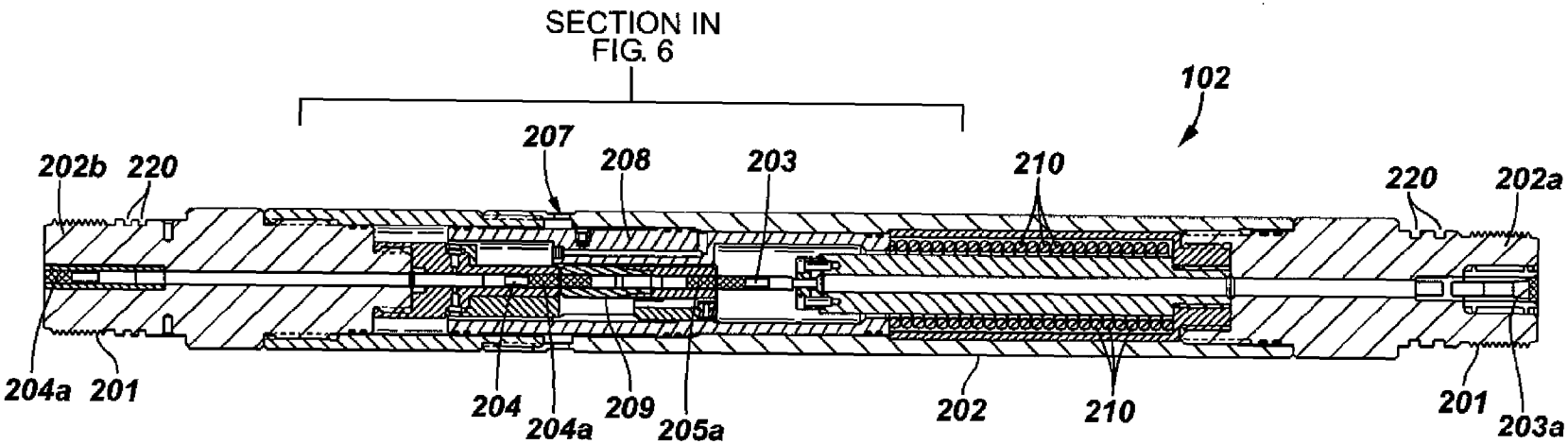
FIG. 4 is a cross-sectional view taken along the longitudinal axis of safety apparatus in accordance with the present invention which illustrates the apparatus in an armed position.

A tubing conveyed perforating system in accordance with the present invention further comprises safety apparatus 102 which is connected in the ballistic train of the tubing conveyed perforating system between the firing head 103 and perforating gun 101. As illustrated in FIGS. 2 and 4, safety apparatus 102 comprises a generally tubular-shaped housing 202 having first and second ends 202*a* and 202*b*, respectively. Each end 202*a* and 202*b* has a threaded portion 201, which enables the safety apparatus 102 to be readily connected in the tubing conveyed perforating system. In other words, safety apparatus is modular in construction. Safety apparatus 102 also includes circumferential grooves 220 for receiving seals, e.g. O-rings (not shown), which function to keep well pressure from entering the inside of the apparatus. As described in more detail below, safety apparatus 102 functions to arm the ballistic train when it is downhole using downhole pressure.

Figure 5:
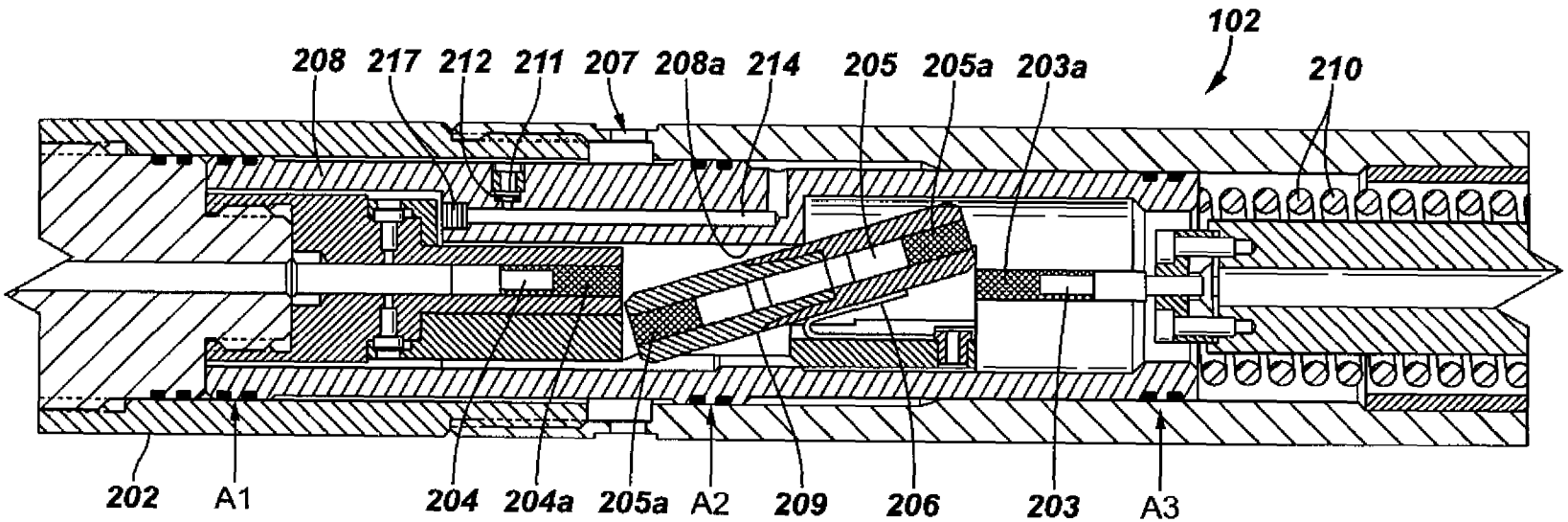
FIG. 5 is an enlarged cross-sectional view of the apparatus contained in box 5 of FIG. 2.

With reference now to FIGS. 2 and 5, a first ballistic section comprising detonating cord 203 with a booster 203*a* on each end extends from first end 202*a* of the safety apparatus 102 to the middle portion of the safety apparatus, while a second ballistic section comprising detonating cord 204 with a booster 204*a* on each end extends from the second end 202*b* to the middle of the safety apparatus. Boosters 203*a* and 204*a* are securely connected to detonating cords 203 and 204, respectively. In one embodiment, these secure connections may be made by crimping the boosters to the detonating cords.

Figure 3:
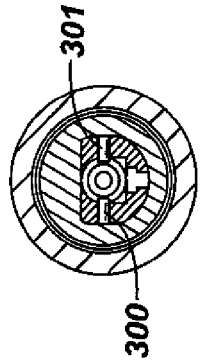
FIG. 3 is a cross-sectional view of the apparatus in FIG. 2 taken along line 3, 3' of FIG. 2.

Still referring to FIG. 5, safety apparatus 102 comprises a third ballistic section comprising detonating cord 205 with boosters 205*a* on each end thereof. Boosters 205*a* are securely attached to the ends of detonating cord 205 e.g., by crimping. The third ballistic section is securely mounted in a structure 209, which is rotatably mounted in safety apparatus 102. Such rotatable mounting may be effected by using suitable devices such as pivot pins. Alternatively, the structure 209 containing third ballistic section may be rotatably mounted in the housing by using trunions 300 and 301, as illustrated in FIG. 3.

With reference still to FIG. 5, safety apparatus 102 further comprises sealed annular piston 208, which surrounds the structure 209, and compression spring 210 which holds annular piston 208 in its initial position shown in FIGS. 2 and 5, when safety apparatus 102 is not subjected to pressure.

Figure 6:
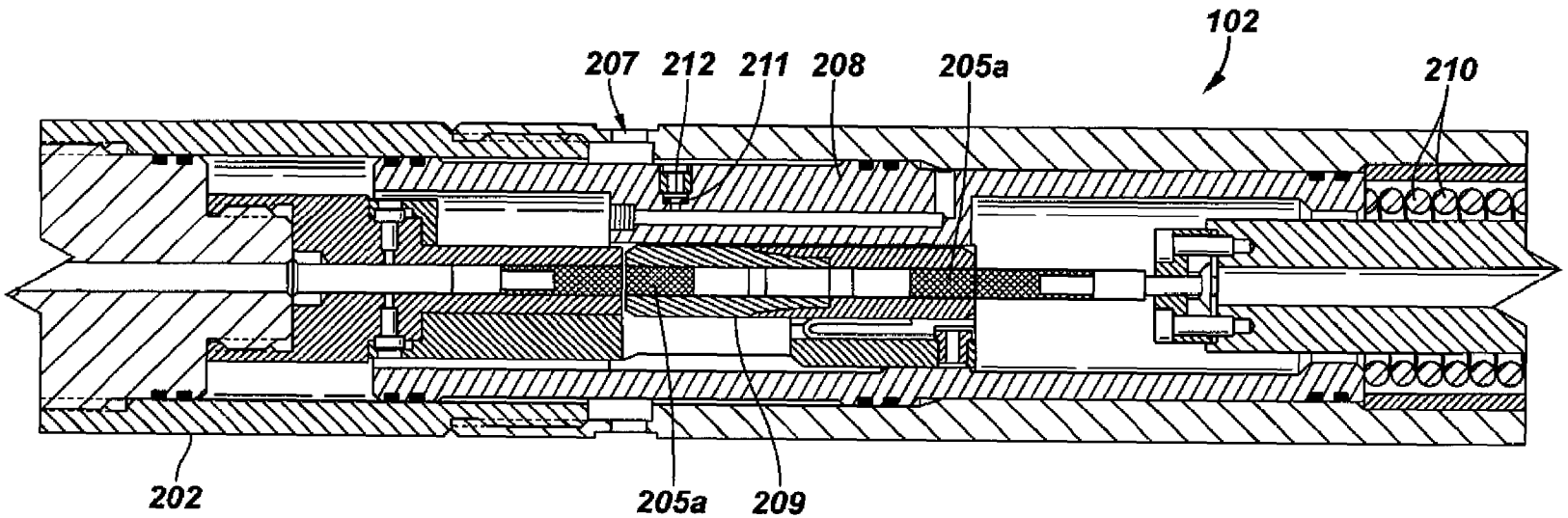
FIG. 6 is an enlarged cross-sectional view of the apparatus contained in box 6 of FIG. 4.

The annular piston 208 has two different seal diameters, designated A1 and A2 in FIG. 5, where A2>A1. This difference in diameter results in the annular piston 208 being biased to move against the force of and compress compression spring 210 when pressure, e.g. downhole pressure, is applied via radial port 207. Surface 208*a* on the inside of annular piston 208 is in contact with the structure 209 containing the third ballistic section. As pressure is increased, the biased annular piston 208 moves to the position shown in FIGS. 4 and 6, and in doing so, surface 208*a* causes the structure 209 containing the third ballistic section to rotate into the armed position. The third ballistic section is now aligned with the first and second ballistic sections. At this time, a ballistic train exists between the firing head and the perforating guns, and the guns may be detonated.

The pressure on the annular piston 208 may be relieved by bringing the tubing conveyed perforating system out of wellbore. Upon relieving the pressure on the annular piston, the compression spring 210 forces the annular piston 208 back to its initial position as shown in FIG. 2. The contact surface 208*a* on the inside of the annular piston 208 moves back allowing the spring 206 under the structure 209 to rotate the third ballistics section out of alignment with the first and second ballistic sections as shown in FIGS. 2 and 5, i.e., back to a safe position. Spring 206 may, for example, be a leaf spring.

Safety apparatus according to the present invention may further comprise structure which allows over-pressure to permanently disarm the third ballistic section. This apparatus includes a frangible membrane 211 such as a rupture disc. The frangible membrane 211 is positioned in the annular piston 208 and exposed to wellbore pressure. The frangible membrane 211 may be sealed with O-rings 212 so that a second sealed chamber remains at atmospheric pressure until the frangible membrane 211 is burst. A fluid port 214 is positioned beneath the rupture disc and interconnected with the second chamber. As long as the frangible membrane 211 is intact, the annular piston 208 functions as described above.

If it is desired to permanently disable the annular piston 208, such as before coming out of the hole with perforating guns that have not been detonated, over-pressuring to burst the frangible membrane 211 can be conducted. Once the frangible membrane 211 is burst, well fluid enters the second chamber 213, but is prevented from entering the ballistic train portion of the apparatus by sealing plug 217. The second chamber includes sealing O-rings on the lower end of the biasing piston. These O-rings are sized so that when the frangible membrane 211 is burst, the annular piston 208 is moved back to its initial position by a combination of pressure bias due to the difference in seal diameters at A1 and A3 (i.e., A1>A3) and the force exerted by compression spring 210. When the annular piston is back in its initial position, the third ballistic section is no longer aligned with the first and second ballistic sections and the perforating guns cannot detonate. After the frangible membrane 211 is burst, further fluctuations of well pressure have no effect on the position of the annular piston and the third ballistic section permanently remains in the misaligned position. This feature adds an additional safety to permanently disarm the firing head from the guns.

Those skilled in the art, having the benefit of the present disclosure, will appreciate that safety apparatus in accordance with the present invention has a number of advantages over the prior art. Not the least of these advantages is that it is no longer necessary to run the perforating guns into the wellbore before the firing head is run into the wellbore. In other words, by utilizing safety apparatus in accordance with the present invention, the firing head may be lower than the perforating guns in the tubing conveyed perforating string.

Those skilled in the art will also appreciate that a tubing conveyed perforating string may contain a plurality of the safety apparatus modules 102.

What is claimed is:

1. Safety apparatus for providing ballistic train interruption in a perforating system comprising perforating guns and a firing head, said safety apparatus comprising a generally tubular-shaped housing which has first and second ends and which is fabricated to permit the housing to be positioned at any location in the perforating system, comprising:

a first ballistic section in the housing which extends from the first end of the housing to the middle portion of the housing;

a second ballistic section in the housing which extends from the second end of the housing to the middle portion of the housing;

a third ballistic section which is rotatably mounted in the middle portion of the housing to move between a disarmed position and an armed position, the third ballistics section being misaligned with the first and second ballistic sections in the disarmed position and the third ballistic section being aligned with the first and second ballistic sections in the armed position;

an annular piston in the housing which is in a first position when there is no pressure on the safety apparatus and which moves from the first position to a second position when the safety apparatus is subjected to downhole pressure, said movement of the annular piston from the first to second positions causing the third ballistic section to rotate from the disarmed to the armed position; and a compression spring in the housing for exerting a force on the annular piston to hold it in its first position when the safety apparatus is not subjected to pressure and which is compressed by movement of the annular piston from its first to its second position.

2. The safety apparatus of claim 1, further comprising a spring which is operatively coupled to the third ballistic section to assist in holding the third ballistic section in the disarmed position.

3. The safety apparatus of claim 1, wherein the third ballistic section is rotatably mounted in the housing using trunions.

4. The safety apparatus of claim 1, further comprising a frangible member which, when ruptured, functions to keep the annular piston permanently in its first position.

5. The safety apparatus of claim 1, wherein the perforating system is a tubing conveyed perforating system.

6. A perforating system for use in perforating a wellbore, comprising:

at least one section comprising a plurality of perforating guns;

a section comprising a firing head to cause said guns to detonate;

a ballistic train between the firing head and said at least one section of perforating guns;

a safety device which is interposed in the ballistic train and which arms the ballistic train when the safety device is downhole using downhole pressure, said safety device comprising a housing having an armed position and a disarmed position, and the ballistic train comprising a ballistic portion being located within the housing, the ballistic portion comprising:

a first ballistic section in the housing which extends from a first end of the housing to a middle portion of the housing, the first ballistic section comprising explosive material;

a second ballistic section in the housing which extends from a second end of the housing to the middle portion of the housing, the second ballistic section comprising explosive material;

a third ballistic section which is movably mounted in the middle portion of the housing to move between a disarmed position and an armed position, the third ballistic section being misaligned with the first and second ballistic sections in the disarmed position and the third ballistic section being aligned with the first and second ballistic sections in the armed position, the third ballistic section comprising explosive material.

7. The system of claim 6, wherein the safety device disarms the ballistic train when the safety device is not subjected to any pressure.

8. The system of claim 7, wherein the safety device disarms the ballistic train while the system is retrieved from the wellbore.

9. The system of claim 7, wherein the safety device disarms the ballistic train by interrupting the ballistic train in two places.

10. The system of claim 6, wherein the system is a tubing conveyed perforating system.

11. A perforating system for use in perforating a wellbore, comprising:

at least one section comprising a plurality of perforating guns;

a section comprising a firing head to cause said guns to detonate;

a ballistic train between the firing head and said at least one section of perforating guns; and a safety device which is interposed in the ballistic train and which arms the ballistic train when it is downhole using the downhole pressure;

wherein the safety device comprises a generally tubular-shaped housing which has first and second ends, comprising:

a first ballistic section in the housing which extends from the first end of the housing to the middle portion of the housing;

a second ballistic section which extends from the second end of the housing to the middle portion of the housing;

a third ballistic section which is rotatably mounted in the housing to move between an disarmed position and an armed position, the third ballistics section being misaligned with the first and second ballistic sections in the disarmed position and the third ballistic section being aligned with the first and second ballistic sections in the armed position;

an annular piston in the housing which moves from a first position to a second position when the safety apparatus is subjected to a sufficient downhole pressure, said movement of the annular piston causing the third ballistic section to move from the disarmed to the armed position; and a compression spring in the housing for exerting a force on the annular piston to hold it in its first position until a sufficient downhole pressure is encountered to allow the annular piston to move to its second position.

12. The system of claim 6, wherein the firing head is positioned in the system such that the firing head enters the wellbore before the perforating guns enter the wellbore.

13. A method of operating a perforating system having a firing head, perforating guns, a ballistic train between the firing heads and perforating guns, and a safety device interposed within the ballistic train, the safety device comprising a housing having an armed position and a disarmed position, and a ballistic portion being located within the housing, the ballistic portion comprising;

a first ballistic section in the housing which extends from a first end of the housing to a middle portion of the housing, the first ballistic portion comprising explosive material;

a second ballistic section in the housing which extends from a second end of the housing to the middle portion of the housing, the second ballistic portion comprising explosive material;

a third ballistic section which is movably mounted in the middle portion of the housing to move between a disarmed position and an armed position, the third ballistic section being misaligned with the first and second ballistic sections in the disarmed position and the third ballistic section being aligned with the first and second ballistic sections in the armed position, the third ballistic portion comprising explosive material;

the method comprising arming the ballistic train downhole using the downhole pressure.

14. The method of claim 13, further comprising the step of disarming the ballistic train as the system is retrieved from the wellbore.

15. The method of claim 13, wherein the ballistic train is permanently disarmed before the system is retrieved from the wellbore.

16. The system of claim 6, wherein the housing is generally tubular shaped.

17. The method of claim 13, wherein the housing is generally tubular shaped.

18. The system of claim 6, wherein the explosive material is detonation cord.

19. The method of claim 13, wherein the explosive material is detonation cord.

20. The system of claim 6, wherein the explosive material of the third ballistic portion is detonation cord.

* * * * *